United States Patent [19]

Poutiainen et al.

[11] Patent Number: 4,545,223

[45] Date of Patent: Oct. 8, 1985

[54] PADLOCK

[75] Inventors: Heikki Poutiainen; Henrikki Malminen, both of Joensuu, Finland

[73] Assignee: Oy Wartsila Ab, Helsinki, Finland

[21] Appl. No.: 464,467

[22] Filed: Feb. 7, 1983

[51] Int. Cl.[4] ..... E05B 67/22

[52] U.S. Cl. ..... 70/38 A; 70/52; 70/368

[58] Field of Search ..... 70/367–369, 70/52, 38 A, 20, 57; 411/378, 209, 221, 315

[56] References Cited

U.S. PATENT DOCUMENTS

| | | | |
|---|---|---|---|
| 197,582 | 11/1877 | Young | 70/26 |
| 2,058,895 | 10/1936 | Lowe | 70/368 X |
| 3,172,279 | 3/1965 | Patriquin | 70/38 A |
| 3,710,603 | 1/1973 | Miller | 70/52 X |
| 3,952,565 | 4/1976 | Falk | 70/52 X |
| 4,138,868 | 2/1979 | Richards, Sr. | 70/367 X |
| 4,290,279 | 9/1981 | Fish et al. | 70/367 X |

*Primary Examiner*—Robert L. Wolfe
*Attorney, Agent, or Firm*—McAulay, Fields, Fisher, Goldstein & Nissen

[57] ABSTRACT

A padlock, which comprises a lock casing and a basically U-shaped shackle slidable therein between a closed and an open position. The shackle has two legs of different length, of which at least one is provided with a locking notch. The padlock also comprises a cylinder lock mechanism, operable by a key, and at least one locking member coacting with a guiding portion of a turnable member of the cylinder lock mechanism for locking the shackle to the lock casing. The locking member is movable dependent on the angular position of the guiding portion of the cylinder lock mechanism between a locking and a releasing position. The releasing position allows the shorter shackle leg to completely slide out from the lock casing. A retaining member is attached to the lock casing in order to keep the cylinder lock mechanism properly fitted in the lock casing. The removal of the retaining member from the lock casing requires turning of the retaining member in relation to the lock casing. A blocking member is dimensioned in its blocking position to be partly received in a recess in the retaining member and partly in an opening in the lock casing. Thereby it prevents the turning of the retaining member in relation to the lock casing. The blocking member is removable from its blocking position when the shackle is in its open position.

20 Claims, 5 Drawing Figures

PADLOCK

BACKGROUND OF THE INVENTION

The invention relates to a padlock with a removable cylinder lock mechanism. There are previously known padlocks in which the elements of the lock mechanism can be replaced, thus making it possible to change the opening combination of the lock. Examples of this are shown in U.S. patent application No. 535,549, filed Sept. 26, 1983 which is a continuation of U.S. Pat. application No. 240,193, filed 1981-03-03, now abandoned and in U.S. patent specification No. 3,835,675. In these known padlocks, there is a slideable lid element, which has to be removed before the replacement of the lock mechanism is possible.

SUMMARY OF THE INVENTION

A padlock, which can be assembled as late as at the moment of purchase is economically advantageous, because different kinds of padlocks can be assembled from the same components. This gives the lock retailers an opportunity to decrease stocking levels. The possibility to change the opening combination of the lock is of great interest even for the consumer. A lost key, for instance, does not result in a need of a complete new padlock, a rearranging of the cylinder lock mechanism is enough to guarantee safety against misuse.

The main object of the invention is to produce a new uncomplicated and inexpensive construction, applicable on padlocks with a cylinder lock mechanism. This construction makes it possible to replace the lock members, including the lock mechanism members, without destroying the lock.

The object of the invention is obtained by means of the lock hereinafter described. The lock comprises a lock casing and a U-formed shackle slideable therein. The shackle has two legs of different length, of which at least one is provided with a locking notch. The lock also comprises a cylinder lock mechanism, operable by a key, locking members, a retaining member to keep the cylinder lock mechanism enclosed in the lock casing and a blocking member to keep the retaining member unremovable from the same casing.

In a padlock according to the invention, the shackle is slideable in the lock casing between an open and a closed position. In its closed position, the shackle is firmly locked to the lock casing by means of the locking members, which are partly received by notches in the shackle, when the cylinder lock mechanism is in its locking position. In a guiding portion of the cylinder lock mechanism there are recesses enabling the locking members to move radially inwards in relation to the cylinder lock mechanism, when the last mentioned is turned from its locking position to a releasing position, by means of the key of the lock. When the cylinder lock mechanism is in its releasing position, the shackle is slideable to its open position.

The cylinder lock mechanism is enclosed in the lock casing by a retaining member. For removing this retaining member it has to be turned in relation to the lock casing. This turning movement is prevented by a blocking member, which can be removed when the shackle is in its open position, but not when the shackle is in its closed position.

After removal of the blocking member and the retaining member, the cylinder lock mechanism can be removed from the lock casing, and after that, the locking members and the shackle can be removed. In this way the padlock can be disassembled. The assembly of the padlock proceeds in reversed order.

DESCRIPTION OF THE PREFERRED EMBODIMENTS

Figure 1:
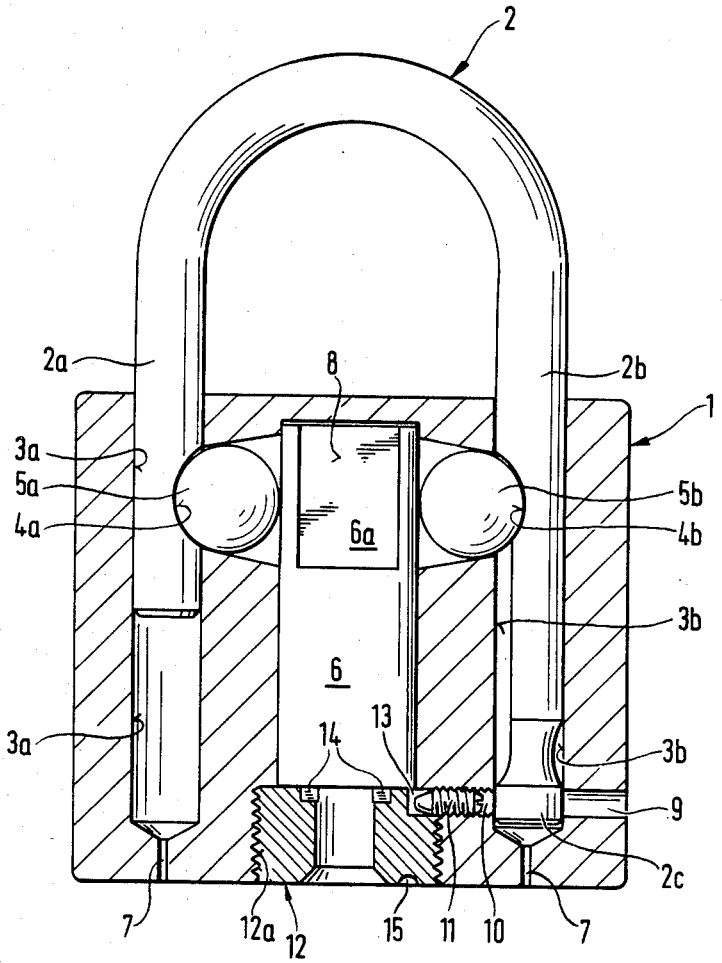
FIG. 1 is a shackle—plane section of a locked padlock according to the invention.

In the drawing, reference numeral 1 indicates a lock casing and numeral 2 a shackle with two legs 2*a* and 2*b* of different length. In the lock casing there are borings 3*a* and 3*b* for said legs. The shackle legs are provided with notches 4*a* and 4*b* receiving spherical locking members 5*a* and 5*b*. The head 2*c* of the longer shackle leg 2*b* is somewhat thicker than the portion extending from this head up to notch 4*b*. The padlock is operated by means of a cylinder lock mechanism 6. This mechanism is kept in the casing by means of a retaining member 12, arranged in an opening 12*a* in the lock casing. The lock casing is also provided with drain openings 7.

When the padlock is to be opened, cylinder lock mechanism 6 is first turned into its releasing position, which means that recesses 8 of a guiding portion 6*a* of the cylinder lock mechanism, are brought to face notches 4*a* and 4*b* and locking members 5*a* and 5*b*. The depth of recesses 8 are dimensioned to allow locking members 5*a* and 5*b* to move radially inwards against the cylinder lock mechanism far enough, to enable the shorter leg of shackle 2 to completely slide out from the lock casing, while head 2*c* of the longer shackle leg is still retained in boring 3*b* by locking member 5*b*.

In the lock casing there are two cavities 9 and 10 in line, of which the first extends from the outer surface of the lock casing to boring 3*b* and the second extends from boring 3*b* to opening 12*a*. The inner cavity 10 is concealed from the outside when shackle 2 is in its closed position, but it is operable from the outside when shackle 2 is in its open position. Cavity 10 has threads receiving a similarly threaded blocking member 11. In the embodiment shown in FIG. 1, blocking member 11 is a set screw and retaining member 12 is a threaded ring formed element. In the outer mantle surface of this retaining member there is a recess 13, dimensioned to partly receive blocking member 11. In this way retaining member 12 is blocked from turning by means of the blocking member.

When the cylinder lock mechanism is to be removed, the padlock is first opened, then blocking member 11 is removed by operating it through cavity 9. Now, retaining member 12 is turnable and thus removable. In order to get out the key (not shown) the shackle is locked in its closed position before the removal of the retaining member. The inner mantle surface of retaining member 12 is provided with recesses 14, dimensioned to coact with an expandable tool for the turning of the retaining member.

After the retaining member has been removed, cylinder lock mechanism 6 is free to slide out from the lock casing and the opening combination of the padlock can be changed and the shackle can be replaced by another shackle. The assembly and the locking of the padlock then proceeds in reversed order. In the outer end surface of retaining member 12 there is an indicator mark in the form of a recess 15, indicating when the turning position of the retaining member allows the blocking member to move into recess 13.

Figure 2:
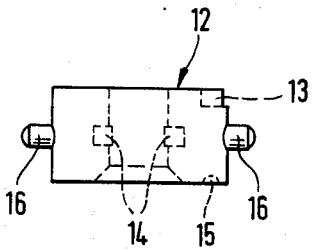
FIG. 2 is a side view of a retaining member provided with bayonet coupling pins.
Figure 3:
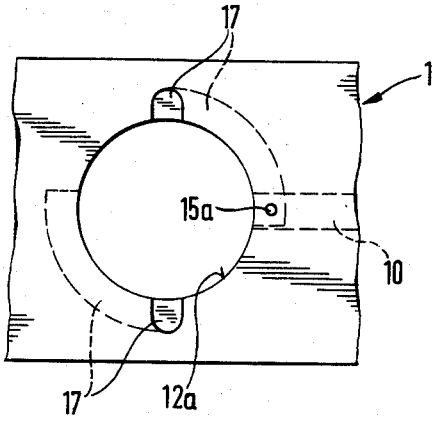
FIG. 3 shows from below a view of a lock casing with a retaining member opening provided with bayonet coupling grooves.

As shown in FIGS. 2–3, retaining member 12 can also be attached to the lock casing by means of a bayonet coupling. Bayonet coupling pins 16 are dimensioned to coact with preferably slightly helical grooves 17 in the lock casing. In the embodiment shown in FIGS. 2–3, there is an indicator mark 15*a* in the lock casing corresponding to mark 15 in retaining member 12. When marks 15 and 15*a* are next to each other, retaining member 12 is in its blocking allowing position.

Figure 4:
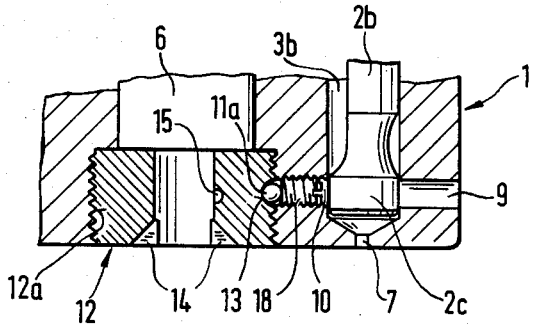
FIG. 4 shows, in section, a way of arranging the blocking of the retaining member.
Figure 5:
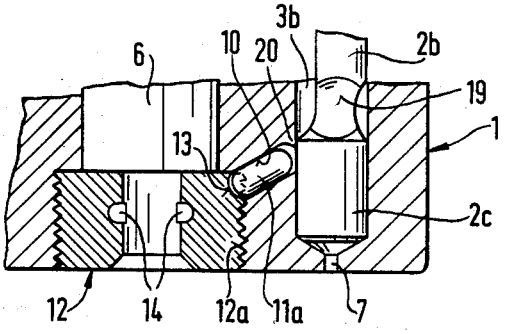
FIG. 5 shows, in section, another way of arranging the blocking of the retaining member.

Blocking member 11 can also be a short separate member 11*a* as shown in FIGS. 4–5. To prevent radial movement outwards from retaining member 12, the blocking member 11*a* can be supported by a supporting member 18 threaded in cavity 10 (FIG. 4), or alternatively cavity 10 can be dimensioned so, that member 11*a* will not completely move into boring 3*b* when shackle 2 is in its open position. This can be achieved by means of a protruding part 20 of the lock casing in cavity 10 as shown in FIG. 5. When shackle 2 is in its open position, the distance to protruding part 20 allows blocking member 11*a* to move into boring 3*b* far enough, to make the turning of retaining member 12 possible. In this embodiment there is no need of threads in cavity 10, neither is cavity 9 necessary. This is because blocking member 11*a* can be inserted and removed from opening 12*a*. The key of the lock can be removed when the shackle is in its open position. For this purpose there is a notch 19 in shackle 2, to partly receive locking member 5*b* (not shown in FIG. 5) when the shackle is in its open position. This construction is described in detail in U.S. patent application No. 240,193, now Ser. No. 535,549. Compared to the embodiment shown in FIG. 1, the embodiments shown in FIGS. 4–5 have many advantages. Blocking member 11*a* can be made from extraordinarly hard material, preferably from hardened steel. In order to increase the strength of the construction, these embodiments also provide the largest possible cross-section for the blocking member. Still another advantage is, that the threads of the blocking member will not get damaged as a result of attempts to turn the retaining member by force while the blocking member is in its blocking position. This is because the threads are either in supporting member 18 or not needed at all. FIG. 4 shows the best mode of the invention.

The invention is not limited to the embodiments shown, but several modifications thereof are feasible within the scope of the attached claims.

We claim:

1. A padlock comprising:

a lock casing, a basically U-formed shackle slideable therein between a closed and an open position, said shackle having two legs of different length, of which at least one is provided with a locking notch;

a cylinder lock mechanism, operable by a key;

at least one locking member coacting with a guiding portion of a turnable member of said cylinder lock mechanism for locking said shackle to said lock casing, said locking member being movable dependent on the angular position of said guiding portion of said cylinder lock mechanism between a locking and a releasing position, the releasing position allowing said shorter shackle leg to slide out completely from said lock casing;

a retaining member attached to said lock casing for maintaining said cylinder lock mechanism properly fitted in said lock casing, said retaining member having a key receiving opening provided for the turning thereof with tool engageable recesses, the removal of said retaining member from said lock casing requiring turning of said retaining member around a longitudinal axis thereof in relation to said lock casing, and said retaining member having a recess; and a blocking member dimensioned in its blocking position to be partly received in said retaining member recess and partly in an opening in said lock casing, thereby preventing the turning of said retaining member in relation to said lock casing, and said blocking member being removable from its blocking position when said shackle is in its open position.

2. A padlock according to claim 1, in which the retaining member is at the key insertion end of said cylinder lock mechanism.

3. A padlock according to claim 1, in which the retaining member is connected to the lock casing by means of a bayonet coupling.

4. A padlock according to claim 1, in which the retaining member is connected to the lock casing by means of threads.

5. A padlock according to claim 1, in which the blocking member is a screw member threaded in the lock casing.

6. A padlock according to claim 1, in which the blocking member is a short separate member.

7. A padlock according to claim 6, in which the blocking member is supported by a supporting member in the lock casing.

8. A padlock according to claim 7, in which the supporting member is a screw member threaded in the lock casing.

9. A padlock according to claim 1, in which said tool engaging recesses are radial recesses engageable by the tool for the turning of said retaining member.

10. A padlock according to claim 1, in which the retaining member is provided with an indicator mark indicating when the angular position of said retaining member allows the blocking member to move into the retaining member recess.

11. A padlock according to claim 10, in which the indicator mark is a recess.

12. A padlock according to claim 2, in which the retaining member is connected to the lock casing by means of a bayonet coupling.

13. A padlock according to claim 1, wherein said lock casing has a cavity aligned with said opening for providing access thereto when said shorter leg completely slides out from said lock casing.

14. A padlock according to claim 1, including a protruding part in said lock casing to prevent said blocking member from completely moving into a boring for the shackle leg when the shackle is in its open position.

15. A padlock comprising:

a lock casing having a pair of spaced borings;

a basically U-formed shackle having two legs of different length, one of said legs being slidable in each of said borings between a closed and an open position, at least one of said legs being provided with a locking notch;

a key operable cylinder mechanism;

at least one locking member coacting with a guiding portion of a turnable member of said cylinder lock mechanism for locking said shackle to said lock casing, said locking member being movable dependent on the angular position of said guiding portion of said cylinder lock mechanism between a locking and a releasing position, the releasing position allowing said shorter shackle leg to slide completely out from said lock casing;

a retaining member attached to said lock casing in order to keep said cylinder lock mechanism properly fitted in said lock casing and enclosed therein, said retaining member having a key receiving opening provided for the turning thereof with tool engageable recesses, the removal of said retaining member from said lock casing requiring turning of said retaining member in relation to said lock casing, and said retaining member having a recess;

a blocking member dimensioned in its blocking position to be partly received in said retaining member recess and partly in an opening in said lock casing, thereby preventing the turning of said retaining member in relation to said lock casing; and means extending transversely to the longitudinal axis of one of said borings for controlling movement of said blocking member into and out of said retaining member recess, and said blocking member cooperating with said transversely extending means for removal thereof from its blocking position when said shackle is in its open position.

16. A padlock according to claim 15, wherein said transversely extending means includes an open portion part opening into one of said borings to permit said blocking member to move thereinto and removal from said recess for unblocking said retaining member.

17. A padlock according to claim 15, wherein said transversely extending means includes an inner cavity in said lock casing and an opening extending from the outside of said casing towards said inner cavity for communication therewith transversely across one of said borings when said shackle is moved towards its open position.

18. A key operable padlock, comprising:

a lock casing having a pair of longitudinally extending spaced borings;

a basically U-formed shackle having two legs of different length, said legs being slidable in said borings between a closed and an open position, at least one of said legs being provided with a locking notch;

a key operable cylinder lock mechanism;

at least one locking member coating with a guiding portion of a turnable member of said cylinder lock mechanism for locking said shackle to said lock casing, said locking member being movable dependent on the angular position of said guiding portion of said cylinder lock mechanism between a locking and a releasing position, the releasing position allowing said shorter shackle leg to slide out completely from said lock casing;

a turnable retaining member attached to said lock casing for covering the entire cylinder lock mechanism and for maintaining said cylinder lock mechanism properly fitted to said lock casing and enclosed therein, said retaining member having a key receiving opening provided for the turning thereof with tool engageable recesses, the removal of said turnable retaining member from said lock casing requiring turning of said retaining member around a longitudinal axis thereof in relation to said lock casing, said longitudinal axis being positioned between said spacing borings and the longitudinal axis thereeach, and said retaining member having a recess;

a blocking member dimensioned in its blocking position to be partly received in said retaining member recess and partly in an opening in said lock casing, thereby preventing the turning of said retaining member in relation to said lock casing; and means extending transversely to the longitudinal axis of one of said borings for controlling movement of said blocking member into and out of said retaining member recess, and said blocking member cooperating with said transversely extending means for removal thereof from its blocking position when said shackle is in its open position.

19. A padlock according to claim 18, wherein said transversely extending means includes a cavity in which said blocking member is freely movable and a protruding part in said lock casing between said cavity and said one of said borings to prevent said blocking member from completely moving into said one of said borings when the shackle is in its open position and an open portion part joining said cavity to said one boring opening into said one boring to permit said blocking member to move thereinto and be removed from said retaining member recess for unblocking said retaining member thereby to permit turning of said retaining member when said blocking member moves into said open portion part, and the shackle leg associated with said last-mentioned boring being movable into said last-mentioned boring when said shackle is in its locked position to move said blocking member into said retaining member recess and exerting pressure on said blocking member for pressure engagement between said blocking member and said retaining member to maintain said blocking member in said retaining member recess.

20. A padlock according to claim 2, in which the retaining member is connected to the lock casing by means of a bayonet coupling.

* * * * *